US008614154B2

(12) United States Patent
Andersen

(10) Patent No.: US 8,614,154 B2
(45) Date of Patent: Dec. 24, 2013

(54) CELLULOSE FIBRE BASED INSULATION MATERIAL

(75) Inventor: Carsten Andersen, Hasselager (DK)

(73) Assignee: 3M Innovative Properties Company, St. Paul, MN (US)

( * ) Notice: Subject to any disclaimer, the term of this patent is extended or adjusted under 35 U.S.C. 154(b) by 155 days.

(21) Appl. No.: 10/577,598

(22) PCT Filed: Oct. 5, 2004

(86) PCT No.: PCT/DK2004/000672

§ 371 (c)(1),
(2), (4) Date: Dec. 18, 2006

(87) PCT Pub. No.: WO2005/042859

PCT Pub. Date: May 12, 2005

(65) Prior Publication Data

US 2007/0209307 A1 Sep. 13, 2007

(30) Foreign Application Priority Data

Oct. 30, 2003 (DK) ..... 2003 01611

(51) Int. Cl.
*B32B 5/02* (2006.01)

(52) U.S. Cl.
USPC ..... 442/136; 442/59; 442/140; 442/327; 428/359

(58) Field of Classification Search
USPC ..... 442/327, 136, 140, 59; 428/359
See application file for complete search history.

(56) References Cited

U.S. PATENT DOCUMENTS

| | | | | | |
|---|---|---|---|---|---|
| 3,772,137 | A | * | 11/1973 | Tolliver | 428/369 |
| 4,118,531 | A | * | 10/1978 | Hauser | 442/344 |
| 4,167,604 | A | * | 9/1979 | Aldrich | 428/359 |
| 5,167,764 | A | * | 12/1992 | Nielsen et al. | 162/146 |
| 5,418,031 | A | * | 5/1995 | English | 428/74 |
| 5,516,580 | A | | 5/1996 | Frenette et al. | |
| 5,554,238 | A | | 9/1996 | English | |
| 5,642,601 | A | | 7/1997 | Thompson, Jr. et al. | |
| 5,858,530 | A | * | 1/1999 | McCullough, Jr. | 428/367 |
| 2003/0068943 | A1 | * | 4/2003 | Fay | 442/76 |

FOREIGN PATENT DOCUMENTS

| | | |
|---|---|---|
| GB | 2 209 352 | 5/1989 |
| JP | 03 269199 | 11/1991 |

OTHER PUBLICATIONS

International Search Report; PCT/DK2004/000672; Feb. 18, 2005.

* cited by examiner

*Primary Examiner* — Peter Y Choi
(74) *Attorney, Agent, or Firm* — James A. Baker

(57) ABSTRACT

The present invention relates to a fiber insulation material for the manufacture of a non-woven fiber batt comprising primary fiber components of a portion of 50% to 90% cellulose fibers;

2% to 20% synthetic fibers, said synthetic fibers being crimped fibers having a length between 12 to 75 mm; and 2% to 20% bi-component fibers comprising a core and an outer sheathing, said outer sheathing having a lower melting point than the core.

Hereby, an inexpensive and voluminous fiber product is achieved having good spring elastic properties as well as good sound and heat insulating properties.

16 Claims, No Drawings

CELLULOSE FIBRE BASED INSULATION MATERIAL

The present invention relates to a fibre insulation material for the manufacture of an air-laid non-woven fibre batt.

From U.S. Pat. No. 5,516,580 an insulation batt is known, where the material contains a portion of cellulose fibres, and longer bonding synthetic fibres. These synthetic fibres are so-called bi-component fibres that have an outer sheath which is heat-fused with outer sheaths of other synthetic fibres at crossing contact points thereof to form a matrix having pockets for retaining a loose fill cellulose fibres therein. This matrix eliminates the need of an adhesive binder to retain the cellulose fibres in the matrix.

The drawback of this insulation board is that the fibre batt obtained hereby is not particularly resilient and the use of longer bi-component synthetic bonding fibres makes the product very expensive to manufacture.

A method of making a resilient mat is known from U.S. Pat. No. 5,554,238. The insulation mat according to this method comprises cellulosic and thermoplastic fibres. A mat is formed in an air-laying process and subsequently the surface is flame-treated to melt the thermoplastic component on the surface forming a skin which keeps the cellulosic fibres intact. The thermoplastic fibres in the interior of the mat remains unmelted, whereby the mat is provided with a spring-back characteristic, which allows the mat to retain most of its original shape after it has been compressed, e.g. for shipping.

However, this resilient mat has a "crisp" exterior surface reducing the resiliency of the mat as a whole and not homogeneously bonded throughout the product, which does not allow for easy handling since the product may easily delaminate or otherwise break up. The insulation effect is moreover reduced due to the more compact structure of the fibre product.

The invention provides a resilient fibreboard material which is inexpensive to manufacture. The invention also provides a resilient fibreboard material which is voluminous whereby providing relatively good insulation properties.

The invention particularly provides a fibre insulation material for the manufacture of a non-woven fire board comprising primary able components of a portion of 50 to 90% cellulose fibres; 2 to 20% synthetic timbres, said synthetic timbres being crimped timbres having a length between 12 to 75 mm; and 2 to 20% bi-component timbres comprising a core and an outer sheathing, said outer sheathing having a lower melting point than the core.

By using three different primary fibre components, a cellulose insulation composition/fibre product according to the invention, which is inexpensive in manufacture is achieved and still containing very good insulation characteristics. It is realised that the expensive bi-component fibre content may be reduced, due to the use of shorter fibres, and the overall weight of the end product relative to the use of raw materials is reduced. This separate portion of synthetic fibres makes the fibre material board resilient. Supporting tearing strength is also achieved by using crimped synthetic fibres.

According to another aspect of the invention, a method of manufacturing a fibre board made of such material is provided, whereby the material is laid onto a forming wire in a air-laid dry forming process and cured in a heat treatment process in which the formed fibre batt is subjected to an air circulation with air heated to a temperature of 90° C. to 145° C., preferably approx. 130° C., hereby heating the entire product composition and thereby activating the bi-component fibres. By the heated air circulation, the bi-component fibres are melted on the outside and thereby becomes tacky and provides an adhesive for the fibres in the fibre mat. The bi-component fibres sticks to the cellulosic fibres and the synthetic fibres, whereby a consistent and homogeneous product is achieved when the fibre product is cooled and the bi-component fibres stiffens. Hereby, a product with a relative large amount of small air pocket is achieved due to the short fibre lengths of the bi-component fibres. The insulation value arises from cells of trapped air interspersed between the cellulosic particulates, which take the form of a free-flowing mixture of small cellulosic particulates (about 1-10 mm in diameter) and short cellulosic fibres (about 0.5-3 mm in length). The particulates take the form of a low-density collection of cellulosic fibres and cellulosic particles. Accordingly, a voluminous fibre product is also achieved having good spring elastic properties as well as good sound and heat insulating properties.

Due to the relative enlargement of the volume of the product, the total amount of fibre material components may be reduced and accordingly the weight of the fibre product may be reduced. This results in a cost effective cellulation insulation product.

The spring elastic characteristics of the fibre product mat according to the invention is also advantageous since this allows for compressing the product during transport, which in turn reduces transport costs and the required transport space. The difficulty lies in finding a way to make the cellulosic particulates bind in such a way that the resulting batt is durable, but yet has the flexibility necessary for it to be folded or rolled for easy packaging and transportation. This is achieved by a product made by a cellulation insulation material according to the invention.

In an embodiment of the fibre material composition, the composition may be provided with fire retarding chemical, such as Borax, Boric acid, Ammonium sulphate or aluminium sulphate mixed with the fibres. The fire-retarding chemical may be in the form of a liquid which is sprayed onto the synthetic fibres in a pre-treatment or provided as a powder in the fibre material. The cellulose fibres may also be saturated with fire-retarding liquid in a pre-treatment of the fibres prior to the forming process. Hereby, the product may additionally be provided with water impermeable properties, since water will penetrate through the fibre batt without damaging the structure in the porous product, since the water (or similar liquids) can flow through the numerous small air channels in the voluminous fibre matrix. The fire retarding chemical content is preferably between 1 to 30% of the fibre material.

In the preferred embodiment, the cellulose fibres have a length between 1 to 10 mm and the bi-component fibres have a length between 1 to 10 mm, preferably with an average length of approx. 3 mm. By using short bi-component fibres, it is possible to ensure a thorough opening/separation of the expensive bi-component fibres and a very homogeneous distribution in the forming process. Furthermore, the advantage of using short bi-component fibres is that they provide more "fibre ends" or contact points resulting in a more consistent end product and allowing for a reduction in the use of bi-component fibres.

The fibre board material is preferably manufactured with a grammar weight of 10 to 50 kg/m$^3$.

By the invention, it is realised that the insulation properties may be further improved by providing synthetic fibres which are hollow. If an improved tear strength is required, the crimped synthetic fibres could be essentially helically shaped fibres. Hereby, a bonding of the synthetic fibres and the other fibre components may be further improved as the adhesiveness of the crimped fibres is enhanced as the uneven shape of the fibres makes them adhere into each other.

The fibre product board may be provided in a sheet, thin mats or web/batts. The product may further be provided with a suitable facing sheet to meet specific product requirements. The facing sheet may be an aluminium foil, a kraft paper, a polyethylene film or any other material, depending on the specific requirements. The board can of course be an unfaced insulation composition board of a regular cross-section.

In the following, the invention is described with reference to a preferred embodiment.

The components of the cellulose insulation composition of the fibre board material according to the invention are provided and mixed. Three primary components of fibres are provided: a portion of cellulose fibres, a portion of crimped synthetic fibres, and a portion of bi-component fibres. In addition, the synthetic fibres may be pre-treated by a fire-retarding agent, just as the cellulose fibres may also be provided with a fire-retardant added to the cellulose insulation composition in general.

The cellulose fibres are short in length and provided in an amount between 50-90%. The cellulose fibres may be short virgin fibres or recycled paper, such as ONP cellulose fibres fabricated from old newsprint, or long cellulose fibres such as cotton, wood fibres, jute or linen. The wood fibres are produced by coarse refining of wood chips. Still further, the cellulose fibres may be derived from so-called "urban wood" which comprises recycled pallets, wood cuttings from construction sites, etc. A mixture of two or more cellulose fibres can also be used to optimise a desired characteristic of a product.

The synthetic fibres are crimped, i.e. wrinkled so that their adhesive properties are enhanced. These wrinkled fibres provide a mechanical bonding of the fibres. Moreover, this shape of the fibres naturally creates an airy product thereby providing the product with good insulation properties.

The bi-component fibres are fibres with a core of polyester or the like and an outer sheath or coating of a thermoplastic material having a lower melting temperature than the fibre core. This ensures a bonding between the fibres in the material as the bi-component fibres become sticky when heated and establish bondings with the outer sheaths of other synthetic fibres at crossing contact points thereof to form a matrix having pockets for retaining a loose fill cellulose fibres therein. This matrix eliminates the need of an adhesive binder or glue to retain the cellulose fibres in the matrix.

The fibre board material is forwarded into a forming section of a air laying forming apparatus. The fibre material enters into a forming head and is secured in a mat on a forming wire underneath said forming head. A vacuum box is provided underneath the forming wire.

EXAMPLES

Example I

A material for forming an insulation fibre mat is mixed by provided the following components:

80% cellulosic fibres of recycled newsprint fibres primed with a fire retardant.

10% synthetic fibres of hollow polyester fibres,

10% bi-component fibres of approx. 6 mm length having a coated polyester core.

Hereby, a cost effective fibre product having a grammar weight of 18-20 kg/m$^3$ is provided, which has a good spring elastic effect and insulation properties.

By the present invention, it is realised that the variations of the above-mentioned example may be performed without departing from the scope of the invention as defined in the accompanying claims.

The invention claimed is:

1. A fibre insulation material comprising primary fibre components of a portion of 50% to 90% cellulose fibres, said cellulose fibres comprising cellulose and having a length between about 0.5 to 10 mm, wherein said cellulose fibres are saturated with a fire-retarding liquid chemical in a pre-treatment wherein the fibre insulation material is provided with water impermeable properties;

a portion of 2% to 20% synthetic fibres, said synthetic fibres being crimped fibres having a length between 12 to 75 mm; and a portion of 2% to 20% bi-component fibres comprising a core and an outer sheathing, said outer sheathing having a lower melting point than the core, wherein said bi-component fibres have a length between 1 to 10 mm and an average length of 3 mm, and wherein said synthetic fibres comprise a fire-retarding chemical in the form of a powder.

2. A fibre insulation material according to claim 1, wherein the content of the fire-retarding chemical is between 1 and 30% of the total fibre material composition.

3. A fibre insulation material according to claim 1, wherein said cellulose fibres having a length between 1 to 10 mm.

4. A fibre insulation material according to claim 1, wherein said fibre insulation material is manufactured with a grammar weight of 10 to 50 kg/m$^3$.

5. A fibre insulation material according to claim 1, wherein said crimped synthetic fibres are helically shaped.

6. A fibre insulation material according to claim 1, wherein said crimped synthetic fibres are hollow.

7. A method of manufacturing a fibre board made of a material according to claim 1, whereby the material is laid onto a forming wire in an air-laid dry forming process and cured in a heat treatment process in which the formed fibre board is subjected to an air circulation with air heated to a temperature of 90 ° C. to 145° C.

8. A fibre insulation material according to claim 1, wherein said crimped synthetic fibers comprise polyester.

9. The method of claim 7, wherein the fibre board is subjected to the air circulation with the air heated to a temperature of approximately 130° C.

10. A fibre insulation material according to claim 1, wherein said fire-retarding chemical comprises at least one of Borax, Boric acid, Ammonium sulphate and Aluminium sulphate.

11. A fibre insulation material according to claim 1, wherein said cellulose fibres consist essentially of cellulose pre-treated with the fire-retarding liquid chemical.

12. A fibre insulation material comprising primary fibre components of:

a portion of 50% to 90% cellulose fibres consisting of cellulose and having a length between about 0.5 to 10 mm, wherein said cellulose fibres are saturated with a fire-retarding liquid chemical in a pre-treatment wherein the fibre insulation material is provided with water impermeable properties;

a portion of 2% to 20% synthetic fibres, said synthetic fibres being crimped polyester fibres having a length between 12 to 75 mm; and a portion of 2% to 20% bi-component fibres comprising a core and an outer sheathing, said outer sheathing having a lower melting point than the core, wherein said bi-component fibres have a length between 1 to 10 mm and an average length of 3 mm, and wherein said synthetic fibres comprise a fire-retarding chemical in the form of a powder.

13. A fibre insulation material according to claim 12, wherein the content of the fire-retarding chemical is between 1 and 30% of the total fibre material composition.

14. A fibre insulation material according to claim 12, wherein said cellulose fibres having a length between 1 to 10 mm.

15. A fibre insulation material according to claim 12, wherein said crimped polyester fibres are hollow.

16. A fibre insulation material according to claim 12, further comprising cellulosic particulates having a diameter from 1 to 10 mm.

* * * * *

UNITED STATES PATENT AND TRADEMARK OFFICE

CERTIFICATE OF CORRECTION

PATENT NO. : 8,614,154 B2
APPLICATION NO. : 10/577598
DATED : December 24, 2013
INVENTOR(S) : Carsten Andersen It is certified that error appears in the above-identified patent and that said Letters Patent is hereby corrected as shown below:

In the Claims

Column 4

Lines 27-28, In Claim 3, delete "wherein said cellulose fibres having a length between" and insert -- further comprising cellulosic particulates having a diameter from --, therefor.

Signed and Sealed this
Nineteenth Day of August, 2014

Michelle K. Lee

Michelle K. Lee
*Deputy Director of the United States Patent and Trademark Office*